US007973292B2

(12) United States Patent
Tsumori et al.

(10) Patent No.: US 7,973,292 B2
(45) Date of Patent: Jul. 5, 2011

(54) NEUTRALIZER

(75) Inventors: Tomonori Tsumori, Tokyo (JP); Naoki Sugita, Tokyo (JP)

(73) Assignee: Midori Anzen Co., Ltd., Tokyo (JP)

( * ) Notice: Subject to any disclaimer, the term of this patent is extended or adjusted under 35 U.S.C. 154(b) by 200 days.

(21) Appl. No.: 12/519,974

(22) PCT Filed: Dec. 18, 2007

(86) PCT No.: PCT/JP2007/074305

§ 371 (c)(1),
(2), (4) Date: Jun. 18, 2009

(87) PCT Pub. No.: WO2008/075677

PCT Pub. Date: Jun. 26, 2008

(65) Prior Publication Data

US 2010/0090096 A1 Apr. 15, 2010

(30) Foreign Application Priority Data

Dec. 19, 2006 (JP) ..... 2006-341803

(51) Int. Cl.
*H05F 3/04* (2006.01)
*H01T 19/04* (2006.01)
*H01T 23/00* (2006.01)

(52) U.S. Cl. ..... 250/424; 250/423 R; 250/423 F; 250/425; 361/213; 361/229; 361/230; 361/231

(58) Field of Classification Search ..... 250/423 R, 250/423 F, 424, 425; 361/213, 229, 230, 361/231; 425/93
See application file for complete search history.

(56) References Cited

U.S. PATENT DOCUMENTS 3,116,433 A * 12/1963 Moncrieff-Yeates .... 315/111.01
(Continued)

FOREIGN PATENT DOCUMENTS

JP 2000058290 2/2000
(Continued)

OTHER PUBLICATIONS

International Search Report from corresponding application PCT/JP2007/074305. English translation included. Dated, Mar. 4, 2008.

*Primary Examiner* — David A Vanore
(74) *Attorney, Agent, or Firm* — NDQ&M Watchstone LLP

(57) ABSTRACT

A neutralizer 1 includes: a power supply circuit 11; an output controlling circuit 12 configured to convert a DC voltage generated by the power supply circuit 11 to a high-frequency voltage with frequency equal to or higher than an audible frequency, and thus to output the resultant high-frequency voltage alternately to two output lines at regular intervals; a transforming circuit 13 configured to raise the high-frequency voltage; a discharger 20 including 2n (n is an integer equal to one or more) discharge needles configured to output positive ions in response to application of a positive polarity voltage, and to output negative ions in response to application of a negative polarity voltage, the discharge needles being disposed while being divided into first and second groups each including n discharge needles; a polarity reversing circuit 14 configured to convert the high-frequency high voltage outputted from the transforming circuit 13, to two rectangular-wave DC high voltages with different polarities during a certain period, and to output the two DC high voltages respectively to the first and second groups in the discharger 20 while reversing the polarities of the two DC high voltages at regular intervals; and an air blower configured to blow air from a windward side of the discharger 20.

4 Claims, 7 Drawing Sheets

U.S. PATENT DOCUMENTS

| | | | | | |
|---|---|---|---|---|---|
| 3,624,448 | A | * | 11/1971 | Saurenman et al. | 361/231 |
| 4,542,434 | A | * | 9/1985 | Gehlke et al. | 361/231 |
| 4,677,704 | A | * | 7/1987 | Huggins | 15/1.51 |
| 4,689,715 | A | * | 8/1987 | Halleck | 361/213 |
| 4,872,083 | A | * | 10/1989 | Blitshteyn | 361/213 |
| 5,153,811 | A | * | 10/1992 | Rodrigo et al. | 361/231 |
| 5,683,556 | A | * | 11/1997 | Nomura et al. | 204/164 |
| 6,118,645 | A | * | 9/2000 | Partridge | 361/231 |
| 6,574,086 | B2 | * | 6/2003 | Noll | 361/229 |
| 6,763,606 | B2 | * | 7/2004 | Saida | 34/97 |
| 7,172,981 | B2 | * | 2/2007 | Kobayashi | 438/800 |
| 7,390,758 | B2 | * | 6/2008 | Kobayashi | 438/800 |
| 7,561,403 | B2 | * | 7/2009 | Onezawa et al. | 361/231 |
| 7,639,472 | B2 | * | 12/2009 | Sekoguchi et al. | 361/230 |
| 7,758,327 | B2 | * | 7/2010 | Leonard | 425/93 |
| 2007/0279829 | A1 | * | 12/2007 | Gefter et al. | 361/213 |
| 2008/0232021 | A1 | * | 9/2008 | Gefter et al. | 361/213 |

FOREIGN PATENT DOCUMENTS

| | | |
|---|---|---|
| JP | 2002043092 | 2/2002 |
| JP | 2006012520 | 1/2006 |
| JP | 2006092888 | 4/2006 |
| JP | 2007287334 | 11/2007 |

* cited by examiner (a)

(b)

(a)

(b)

NEUTRALIZER

TECHNICAL FIELD

The present invention relates to a neutralizer configured to electrically neutralize an electrostatically-charged object by irradiating the object with positive ions and negative ions.

BACKGROUND ART

Conventionally, in order to prevent electrostatic trouble and electrostatic adsorption due to electrostatical-charge of components, neutralizers are placed near working benches, conveyors and the like in a semiconductor device manufacturing line, a cell manufacturing process for mobile phones and the like. The neutralizers used in these working areas include neutralizers which: emit (irradiate) positive ions or negative ions onto a neutralization target object (a component) in which charges are unevenly distributed because positive charges or negative charges are excessive wholly or partially; and thereby electrically neutralize the object. These neutralizers are classified into some types depending on neutralization methods. Descriptions will be hereinbelow provided for characteristics of the methods.

(1) AC-type

An AC-type neutralizer is configured to apply a sine-wave high voltage (with a frequency of 50/60 Hz) to a single discharge needle and thus to cause the needle to alternately generate positive and negative ions. Because both positive and negative ions are generated from the single discharge needle, this type of neutralizer is characterized by having less temporal and spatial deviations of ion balance.

In this respect, "ion balance" indicates how much a residual potential on an object deviates from zero volts after ion irradiation. An idealistic characteristic is that the residual potential is stationarily equal to zero volts. In addition, the temporal deviation of ion balance means that, to while a neutralizer is continuously operated, the residual potential deviates due to differences between positive and negative discharge needles in the degrees of dirt adhesion, erosion and abrasion. On the other hand, the spatial deviation of ion balance means that, when neutralization target objects are irradiated with ions, the residual potentials differ depending on the positions of the neutralization target objects. The spatial deviation of ion balance is determined, as will be described later, by irradiating ions onto neutralization target objects that are located at predetermined distances from a neutralizer, and then by performing a measurement to find a place where a neutralization target object has a residual potential. Moreover, ion balance variation, to be described later, means that the potential on the surface of a neutralization target object periodically varies between positive and negative each time the object is irradiated with positive and negative ions alternately.

(2) DC-Type

A DC-type neutralizer is configured to apply a positive high voltage to a positive discharge needle and a negative high voltage to a negative discharge needle; and thus to cause each of the discharge needles to stationarily produce positive or negative ions. Positive and negative ions thus emitted are less likely to recombine with each other before reaching a neutralization target object. For this reason, the DC-type neutralizer is characterized by being capable of causing ions to travel farther than the AC-type neutralizer does.

(3) AC High-Frequency Type

An AC high-frequency type neutralizer is configured to apply a high-frequency voltage with a frequency of 20 kHz to 70 kHz to a single discharge needle. The AC high-frequency type neutralizer is characterized in that a transformer can be made lighter and smaller than that for the general AC-type neutralizer.

(4) Pulsed DC Type

A pulsed DC-type neutralizer is configured to alternately apply a positive high voltage to a positive discharge needle and a negative high voltage to a negative discharge needle; and thus to cause the discharge needles to alternately produce positive and negative ions. This type of neutralizer is characterized in that the temporal deviation of ion balance is improved as compared with the general DC-type neutralizer. Note that prior art related to the above is disclosed in Japanese Patent Application Laid-Open brochure, No. JP-A 2002-43092 (Patent Document 1).

(5) Pulsed AC Type

A pulsed AC-type neutralizer is configured to apply a rectangular-wave high voltage to a single discharge needle. This type of neutralizer is characterized by being capable of producing more ions than the general AC-type neutralizer does, and of varying its oscillatory frequency (see Patent Document 2). Note that prior art related to the above is disclosed in Japanese Patent Application Laid-Open brochure, No. JP-A 2000-58290 (Patent Document 2).

The foregoing types of neutralizers, however, have problems as follows.

(1) AC Type

A heavier and larger transformer needs to be used to generate a high voltage. As this type of neutralizer is often used while being placed on a working bench or being hanged, a compact and light neutralizer is desirable. However, it is difficult to build a smaller and lighter AC-type neutralizer. In addition, since positive and negative ions are alternately produced, a neutralization target object is charged positively and negatively in an alternate manner. This means the ion balance varies with time. As a result, the AC type neutralizer has difficulty in keeping the residual potential close to zero volts after ion irradiation. Moreover, the AC type neutralizer produces less positive and negative ions than the DC type neutralizer does, and thus is inferior to the DC type neutralizer in terms of the attenuation time characteristic and the neutralization range. Here, the attenuation time characteristic means a time until the potential of a neutralization target object falls into a tolerable level after ion irradiation. If a neutralizer can reduce the potential of a charged neutralization target object to the tolerable level at a shorter length of time, the neutralizer is better in the attenuation time characteristic. In addition, the neutralization range means a spatial range in which a neutralizer can reduce the potential of the neutralization target object to the tolerable level with ion irradiation.

(2) DC Type

During continuous operation, differences occur between the positive and negative discharge needles in the degrees of dirt adhesion, erosion and abrasion. This causes a temporal deviation of ion balance. In addition, depending on where the discharge needles are located, some places are more susceptible to positive ions, and others are more susceptible to negative ions. As a result, a neutralization target object located on each of such places is positively or negatively charged, and thus a spatial deviation of ion balance occurs.

(3) AC High-Frequency Type

This type of neutralizer produces positive and negative ions at short intervals, and thus the emitted positive and negative ions are likely to be recombined with each other before reaching a neutralization target object. This makes it difficult to cause ions to travel far. In addition, less ions reaching the object lead to deterioration in the attenuation time characteristic.

(4) Pulsed DC Type

As is the case with the DC type neutralizer, during continuous operation, differences occur between the positive and negative discharge needles in the degrees of dirt adhesion, erosion and abrasion, and thus a temporal deviation of ion balance occurs. In addition, a spatial deviation of ion balance occurs between a place susceptible to the positive discharge needle that is more likely to be fouled with dirt and a place susceptible to the negative discharge needle that is less likely to be fouled with dirt. As a result, this type of neutralizer positively or negatively charges the neutralization target object. Moreover, as alternately producing positive and negative ions, this type of neutralizer positively and negatively charges the neutralization target object in an alternate manner, like the AC type neutralizer. As a result, the ion balance varies from a temporal point of view.

(5) Pulsed AC Type

As alternately producing positive and negative ions, this type of neutralizer positively and negatively charges the neutralization target object in an alternate manner, and produces more ions than the AC type neutralizer does. For this reason, the ion balance varies from a temporal point of view.

As described above, the conventional types of neutralizers have problems in any of size, weight, attenuation time characteristic, or ion balance characteristic. Currently, there has been developed no neutralizer that overcomes all these problems.

The present invention has been made for solving the foregoing problems. An object of the present invention is to provide a compact and light neutralizer which is better in the attenuation time characteristic and the ion balance characteristic.

DISCLOSURE OF THE INVENTION

For the purpose of attaining the object, a first aspect of the present invention is a neutralizer including: a power supply circuit configured to generate a DC voltage; an output controlling circuit configured to convert the DC voltage generated by the power supply circuit to a high-frequency voltage with frequency equal to or higher than an audible frequency, and to output the resultant high-frequency voltage alternately to two output lines at regular intervals; a transforming circuit configured to raise the high-frequency voltage outputted from the output controlling circuit; a discharger including 2n (n is an integer equal to one or more) discharge needles configured to output positive ions in response to application of a DC high voltage with a positive polarity, and configured to output negative ions in response to application of a DC high voltage with a negative polarity, the discharge needles being disposed in the discharger while being divided into first and second groups each including n discharge needles; a polarity reversing circuit configured to convert the high-frequency high voltage outputted from the transforming circuit, to two rectangular-wave DC high voltages with different polarities during a certain period, to output the two DC high voltages respectively to the first and second groups in the discharger while reversing the polarities of the two DC high voltages at regular intervals; an air blower configured to blow air from a windward side of the discharge needles, and to convey the positive and negative ions outputted from the 2n discharge needles, to a neutralization target object located on a leeward side of the discharge needles. In the neutralizer, during a certain period, ions with one polarity are outputted from the first group in the discharger, whereas ions with the other polarity are outputted from the second group, and. Furthermore, the polarity of the ions outputted from each of the groups is reversed at regular intervals.

A second aspect dependent on the first aspect of the present invention is the neutralizer, wherein the output controlling circuit sets an output switching frequency to be within a range of 10 Hz to 100 Hz, the output switching frequency used to output the high-frequency high voltage alternately to the two output lines at regular intervals.

A third aspect dependent on any one of the first and second aspects of the present invention is the neutralizer, further including a pulsed streamer-corona detector provided between the air blower and the discharger, and configured to detect a pulsed signal generated by corona discharge.

A fourth aspect dependent on any one of the first to third aspects of the present invention is the neutralizer, further including a guard electrode provided between the discharger and the neutralization target object, and connected to a ground potential.

In the neutralizer according to any one of the first to fourth aspects of the present invention, high-frequency wire-wound transformers, piezoelectric transformers or the like corresponding to an oscillatory frequency which is equal to or higher than the audible frequency can be used. Therefore, the neutralizer can be smaller in size and lighter in weight than the AC-type neutralizer.

The neutralizer is configured to apply the two rectangular-wave DC high voltages with polarities different from each other to the first and second groups in the discharger, respectively. For this reason, the neutralizer can produce a larger number of positive and negative ions than the AC-type neutralizer, and is thus capable of making the attenuation time characteristic better. For the same reason, the neutralizer can make the neutralization range wider than the AC-type neutralizer does.

The neutralizer is configured to produce positive and negative ions during the same period from the discharge needles of the two groups thus divided. Concurrently, the neutralizer according is configured to reverse at regular intervals the polarity of ions outputted from each group. For this reason, the neutralizer can simultaneously produce positive and negative ions during the same period, and is thus capable of making the number of positive ions and the number of negative ions almost equal to each other on the front surface of the neutralization target object. Accordingly, the neutralizer enhances neutralization of the potential, and is thus capable of reducing the residual potential on the front surface of the neutralization target object. Consequently, the neutralizer can make the variation of ion balance nearly equal to zero, and can concurrently reduce the deviation of the variation.

In addition, the neutralizer is configured to reverse the polarities of positive and negative ions emitted at regular intervals, and is concurrently configured to switch places from which positive and negative ions are emitted at regular intervals. For this reason, the neutralizer can prevent the neutralization target object from being affected by either positive or negative ions depending on where the neutralization target object is located, and is thus capable of almost evenly irradiating positive and negative ions onto the neutralization target object located any places. Consequently, the neutralizer can minimize the spatial deviation of ion balance.

Moreover, the neutralizer is configured to reverse at regular intervals the polarities of positive and negative ions emitted from the discharge needles of the groups. For this reason, even when the neutralizer is continuously operated, the discharge needles of each group become almost equally fouled with dirt, eroded and abraded. Consequently, the residual potentials of the discharge needles do not deviate, and the temporal deviation of ion balance can be reduced.

BRIEF DESCRIPTION OF THE ACCOMPANYING DRAWINGS

FIG. 1 is a diagram of an overall configuration of a neutralizer according to an embodiment.

FIG. 2(*a*) and FIG. 2(*b*) are explanatory diagrams each showing a configuration of a discharger.

Figure 6:
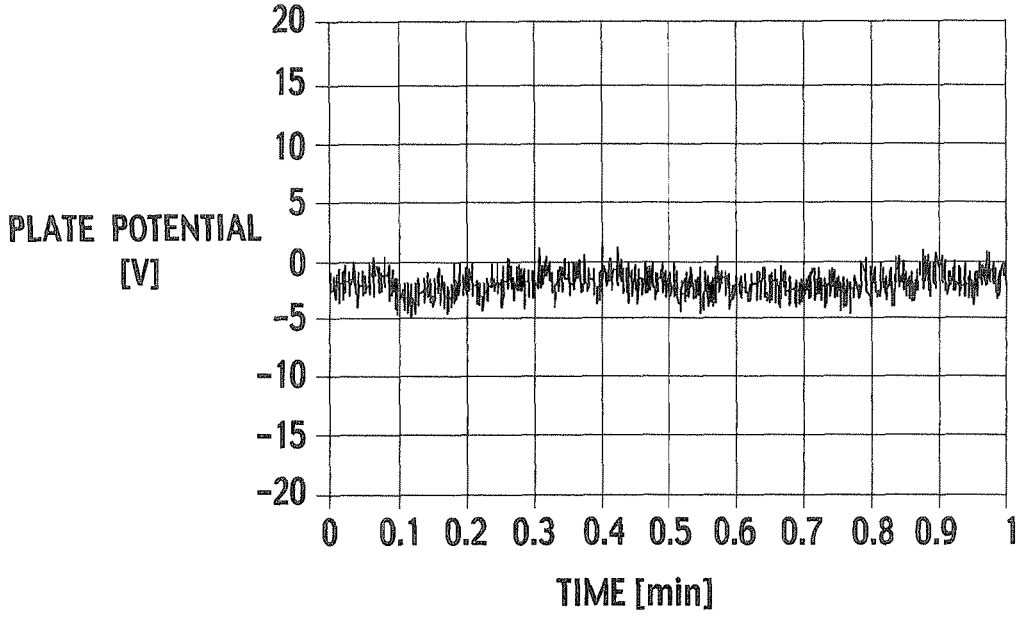
Figure 6:
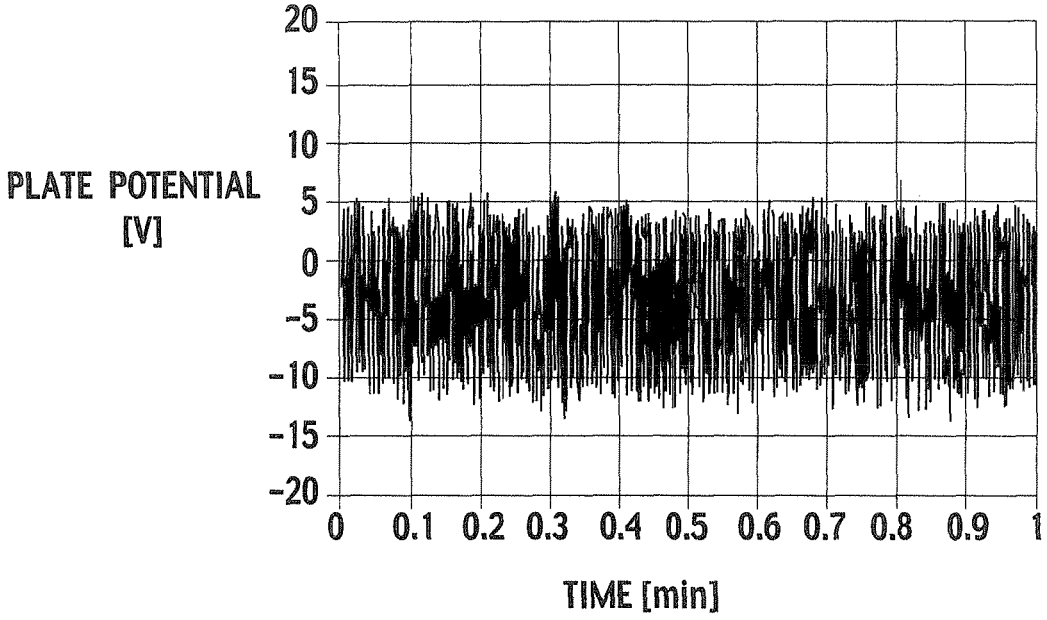

FIG. 6(*a*) and FIG. 6(*b*) are diagrams each showing an ion balance variation-time characteristic. Specifically, FIG. 6(*a*) is a diagram showing a characteristic exhibited by the neutralizer according to the present embodiment, and FIG. 6(*b*) is a diagram showing a characteristic exhibited by a pulsed AC-type neutralizer as a comparative example.

Figure 7:
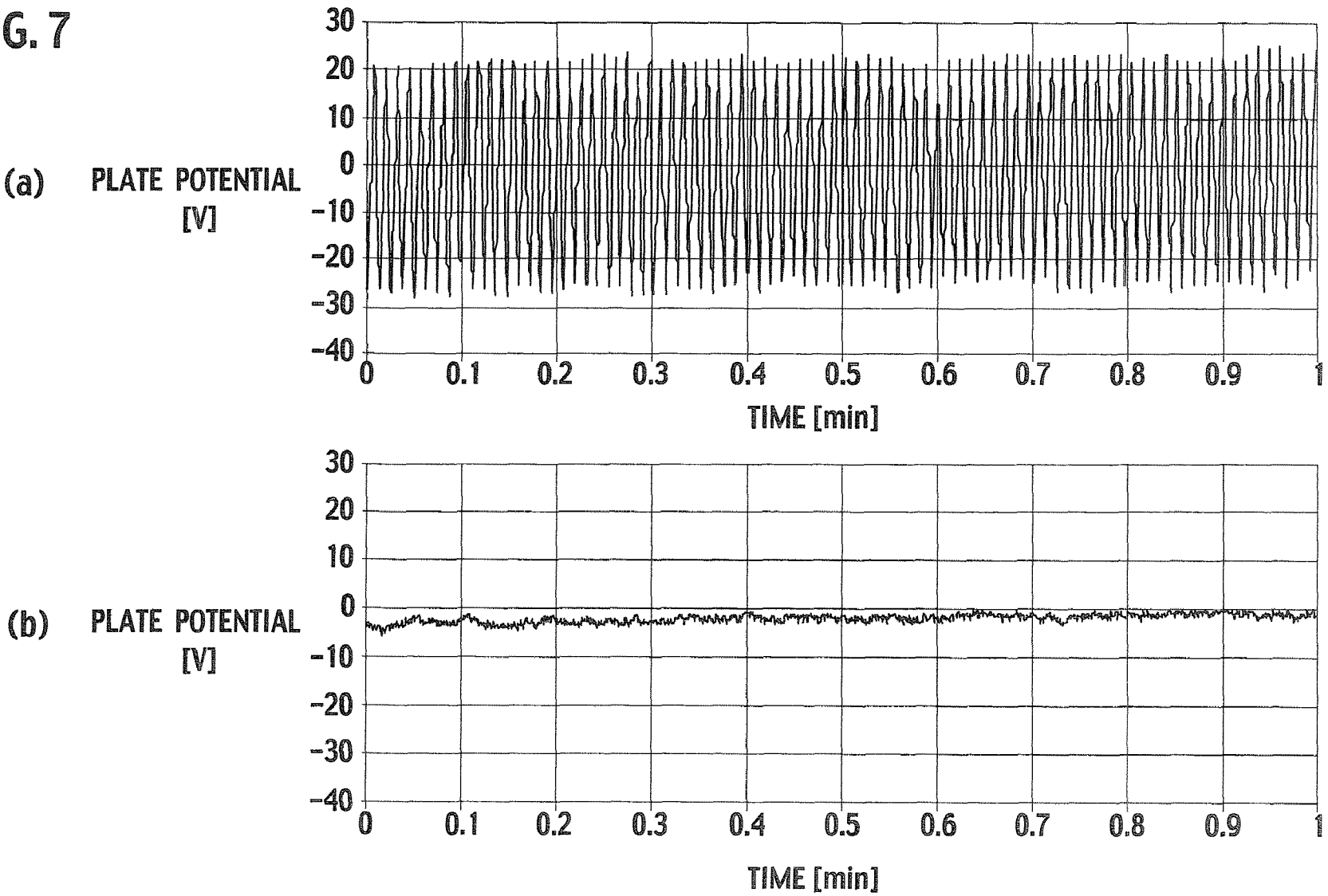

FIG. 7(*a*) and FIG. 7(*b*) are diagrams each showing an ion balance variation-time characteristic exhibited by the neutralizer according to the embodiment. Specifically, FIG. 7(*a*) is a diagram showing a characteristic when an output switching frequency is set at 1.4 Hz, and FIG. 7(*b*) is a diagram showing a characteristic when the output switching frequency is set at 35 Hz.

Figure 8:
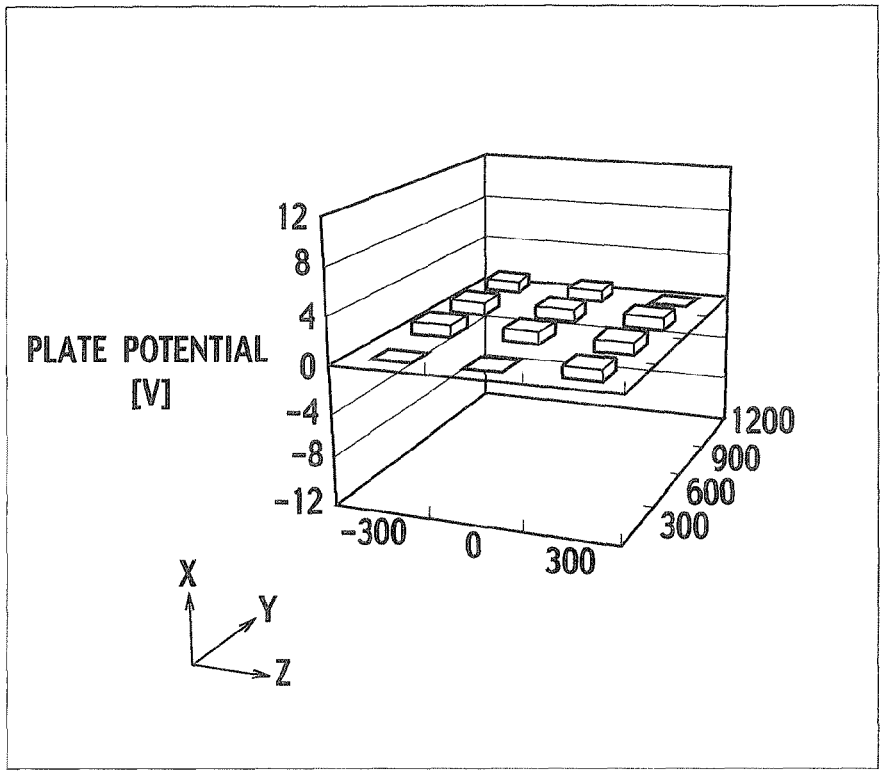
Figure 8:
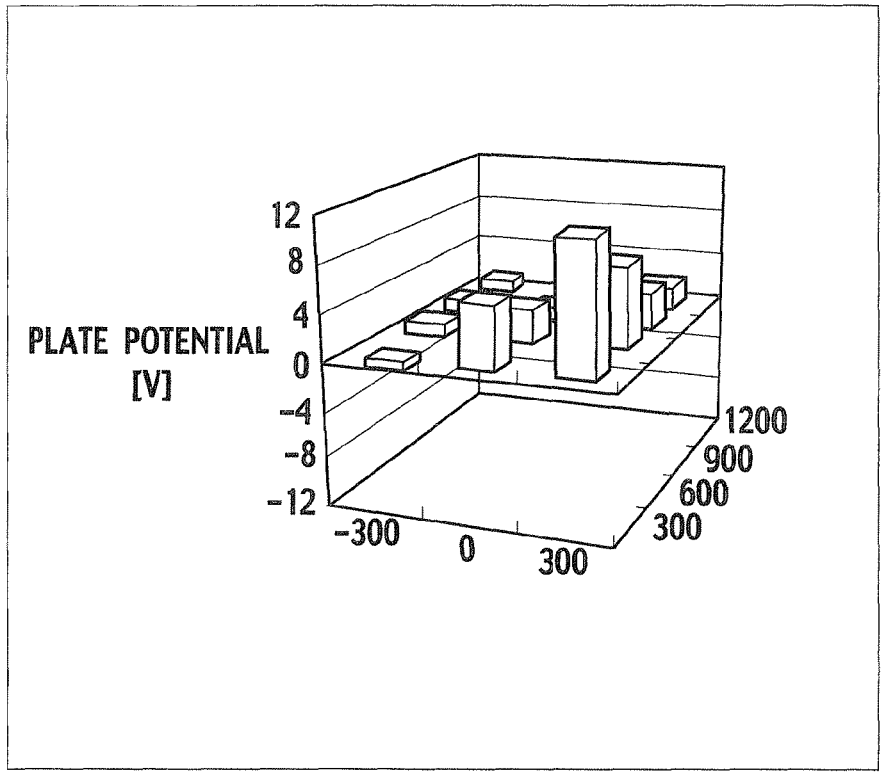

FIG. 8(*a*) and FIG. 8(*b*) are diagrams each showing an ion balance space characteristic. Specifically, FIG. 8(*a*) is a diagram showing the characteristic exhibited by the neutralizer according to the embodiment, and FIG. 8(*b*) is a diagram showing the characteristic exhibited by a DC-type neutralizer as a comparative example.

BEST MODE FOR CARRYING OUT THE INVENTION

Descriptions will be hereinblow provided for an embodiment of a neutralizer according to the present invention on a basis of the drawings.

Figure 1:
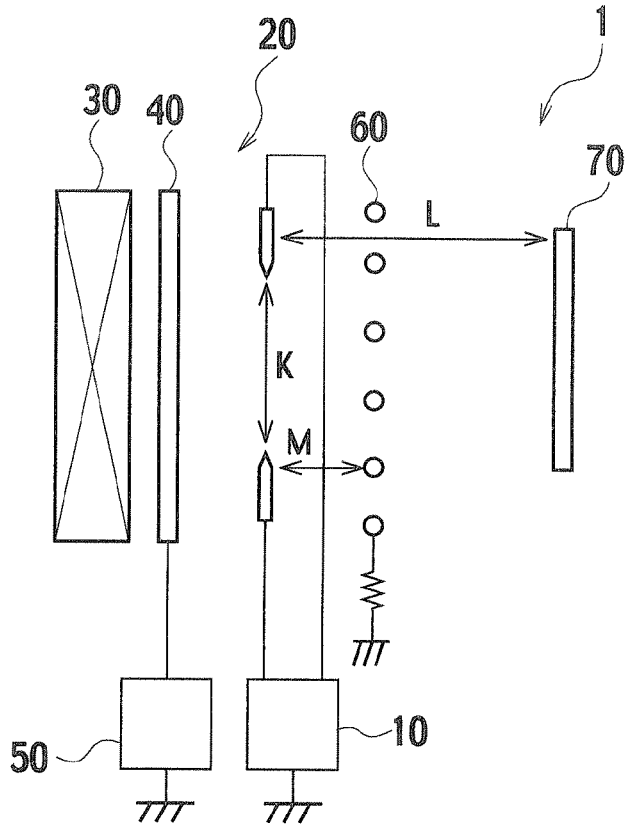
Figure 2:
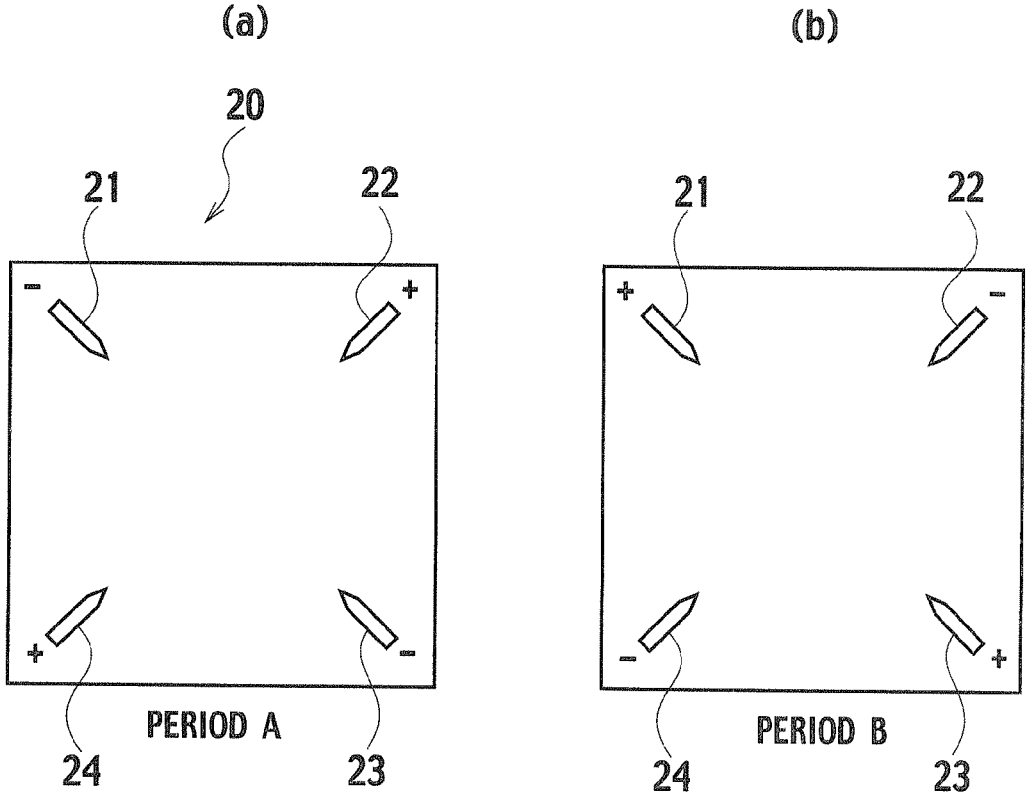
Figure 3:
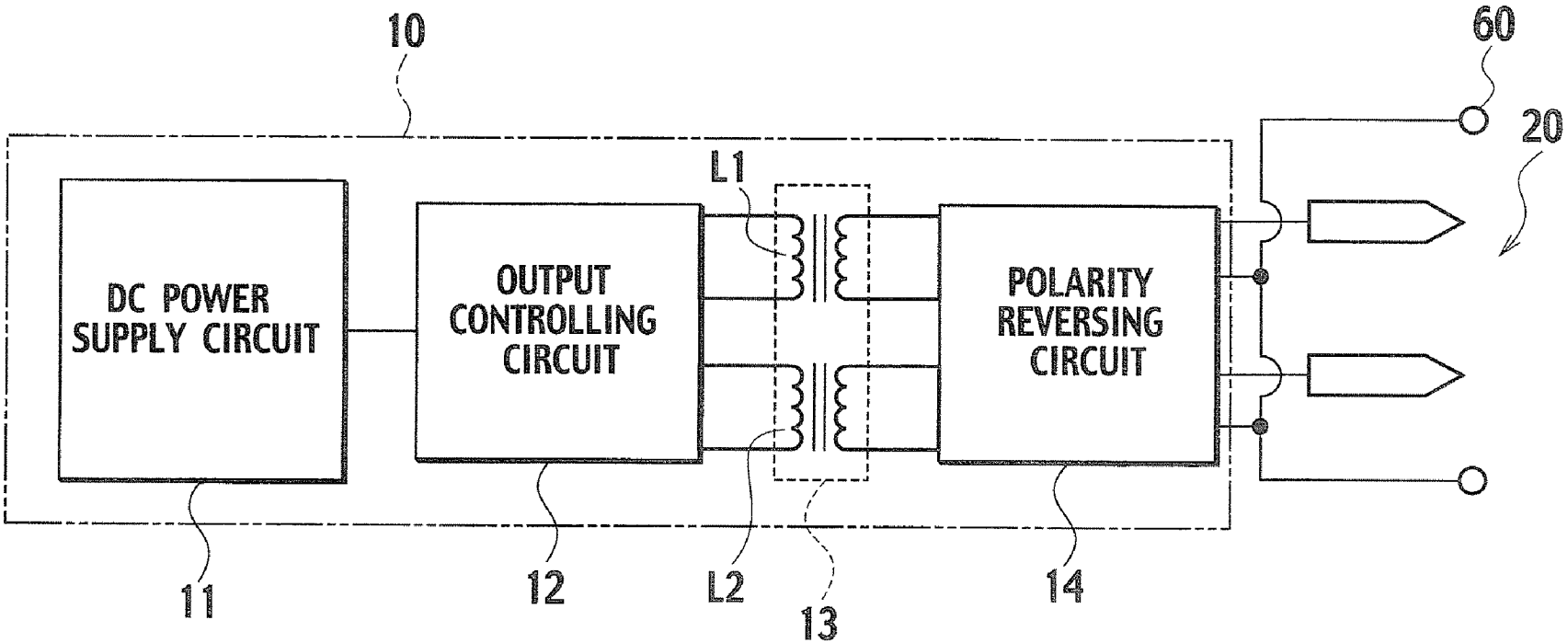
FIG. 3 is a block diagram showing a configuration of a high-voltage-generating circuit.

FIG. 1 is a diagram of an overall configuration of the neutralizer according to the present embodiment, FIG. 2 is an explanatory diagram showing a configuration of a discharger, and FIG. 3 is a block diagram showing a configuration of a high-voltage-generating circuit.

As shown in FIG. 1, the neutralizer 1 includes a high-voltage-generating circuit 10, a discharger 20, an air blower 30, an electrode 40 for detecting the pulsed streamer-corona, a detecting device 50 of the pulsed streamer-corona signal and a guard electrode 60. Reference numeral 70 denotes a neutralization target object.

The high-voltage-generating circuit 10 is a circuit configured to simultaneously apply DC high voltages with different polarities to the discharger 20 in an alternate manner at regular intervals. Descriptions will be provided for the configuration of the high-voltage-generating circuit 10 later.

As shown in FIG. 2, the discharger 20 is configured by including discharge needles 21 to 24 serving as discharge electrodes. These discharge needles output positive ions while a DC high voltage with a positive polarity is applied thereto, and output negative ions while a DC high voltage with a negative polarity is applied thereto. When the DC high voltage supplied from the high-voltage-generating circuit 10 is applied to the discharge needles 21 to 24, a corona discharge takes place between the discharge needles 21 to 24 and the guard electrode 60. Thus, the discharge needles 21 to 24 output positive or negative ions. The high-voltage-generating circuit 10 supplies the discharger 20 with the DC high voltages with polarities in an alternate manner at regular intervals.

As shown in FIG. 2, the discharge needles 21 to 24 are disposed respectively in four locations in a way that their tip ends are pointed toward the center. Out of the discharge needles 21 to 24, two discharge needles having their tip ends opposed to each other constitute an electrode pair (group) configured to output ions with the same polarity. In the present embodiment, the discharge needles 21 and 23 constitute a first group, whereas the discharge needles 22 and 24 constitute a second group. While one of the groups outputs positive ions, the other group simultaneously outputs negative ions. In contrast, while one of the groups outputs negative ions, the other group simultaneously outputs positive ions.

For example, as shown in FIG. 2(*a*), during a period A, the discharge needles 21 and 23 of the first group output negative ions, whereas the discharge needles 22 and 24 of the second group output positive ions. In contrast, as shown in FIG. 2(*b*), during a next period B, the discharge needles 21 and 23 of the first group output positive ions, whereas the discharge needles 22 and 24 of the second group output negative ions. Thereafter, similarly, the two groups repeat outputting ions alternately for the period A and the period B at predetermined intervals.

In the present embodiment, as shown in FIGS. 2(*a*) and 2(*b*), two opposed discharge needles always receive voltages with the same polarity. The adoption of this configuration can enhance the ion balance characteristics. Instead, two opposed discharge needles may always receive voltages with different polarities. In addition, the number of discharge needles may be 2n (n is an integer equal to one or more) instead of the four as in the present embodiment.

Furthermore, as shown in FIG. 1, the discharge needles 21 to 24 are disposed at an almost right angle to a direction in which the air blower 30 blows the air (a direction from the left to the right on FIG. 1). The inter-electrode distance K between two discharge needles with different polarities is determined based on the spatial ion balance performance and a distance L between the apparatus main body in use and the neutralization target object 70. As an example, a desirable range of K is approximately 40 mm to 120 mm when L=150 mm to 600 mm.

The air blower 30 is disposed on the upstream side of the discharger 20. In other words, the discharger 20 is disposed on the downstream side of the air blower 30. The air blower 30 is configured to blow the air by rotating a fan (not illustrated) using a motor. Positive and negative ions both outputted from the discharger 20 are conveyed to the neutralization target object 70 by the air thus blown.

The electrode 40 for detecting the pulsed streamer-corona is disposed between the air blower 30 and the discharger 20. The electrode 40 detects a discharge current produced due to the corona discharge in the discharger 20, and outputs a pulsed signal (detection signal) depending on the detected discharge current. On the basis of the pulsed signal outputted from the electrode 40, the detecting device 50 of the pulsed streamer-corona signal judges whether or not the discharge condition of the coronal discharge is normal. Specifically, when the pulsed signal depending on the detected discharge current exceeds a predetermined level, the detecting device 50 can determine that the corona discharge is in an abnormal condition. That is because, when a pulsed streamer-corona discharge takes place, the discharge current produced due to the corona discharge largely changes (exhibits very sharp changes) in a short time. In general, it is known that, as a discharge needle becomes fouled with dirt, abnormal corona discharge conditions more frequently take place. For this reason, provision of a device which detects abnormal conditions of the corona discharge allows users to know an exact timing when the discharge needles should be cleaned. This makes it possible to maintain the discharge needles securely. Note that the electrode 40 together with the detecting device 50 have the function as a pulsed streamer-corona detector for the present embodiment.

The guard electrode 60 is configured to prevent fingers of an operator or the like from touching the discharge needles to which the high voltages are applied and is disposed between the discharger 20 and the neutralization target object 70. The guard electrode 60 is connected to the ground potential, and thus functions as counter electrodes for the respective discharge needles. The guard electrode 60 is desirably made of an electrically-conductive material such as a metal in order to make the voltage of the neutralization target object 70 less fluctuated by induction. In addition, concentrically-arranged ring-shaped metal electrodes are used as a structure of the guard electrode 60. However, the structure is not limited to this example, but any structure may be used as long as the electrodes are arranged at intervals as narrow as to prevent fingers of the operator from entering in between, and wide enough to allow ions to easily pass in between. Furthermore, it is desirable that the guard electrode 60 should be disposed so as to be separated from the discharge needles with a distance M (<the inter-electrode distance K). When the discharger 20 starts the corona discharge, the positive and negative ions produced are caused to travel toward the guard electrode 60. That is because the potential difference between the guard electrode 60 and each of the discharge needles is larger than the potential difference between the discharge needles. Here, with the provision of the guard electrode 60, some of positive and negative ions are captured and thereby decreasing the attenuation time characteristic. Nevertheless, the provision of the guard electrode 60 largely decreases the variation of ion balance.

Next, descriptions will be provided for a configuration of the high-voltage-generating circuit 10. As shown in FIG. 3, the high-voltage-generating circuit 10 is configured by including a DC power supply circuit 11, an output controlling circuit 12, a transforming circuit 13 and a polarity reversing circuit 14.

The DC power supply circuit 11 is a circuit connected to an unillustrated AC power supply (AC 100V), and configured to convert the AC voltage to the DC voltage (DC 12V) and output the voltage thus converted.

The output controlling circuit 12 is configured to convert the DC voltage outputted from the DC power supply circuit 11 to a high-frequency voltage with frequency equal to or higher than an audible frequency (20k Hz or higher), and is concurrently configured to switch this high-frequency voltage to alternately output the voltage to two output lines connected to the transforming circuit 13 at regular intervals. In the present embodiment, the output switching frequency at which the output controlling circuit 12 alternately outputs the high-frequency voltage to the two output lines at the predetermined intervals is set in a range of 10 Hz to 100 Hz. When, for example, the output switching frequency is set at 50 Hz, one cycle requires 0.02 seconds. For this reason, its half cycle of 0.01 seconds is set as the predetermined time interval.

In the present embodiment, the output switching frequency at which the output controlling circuit 12 alternately outputs the high-frequency voltage to the two output lines is set in the range of 10 Hz to 100 Hz. Accordingly, the polarities of positive and negative ions outputted from the discharge needles of the two groups are reversed at regular intervals determined by the output switching frequency. This allows positive and negative ions to be generated at longer intervals. Accordingly, the neutralizer according to the present embodiment makes thus-emitted positive and negative ions less likely to be recombined with each other before the ions reach the neutralization target object, compared to the ions emitted by the AC high-frequency type neutralizer, and is thus capable of causing the ions to travel farther.

The transforming circuit 13 is configured by including high-frequency wire-wound transformers or piezoelectric transformers corresponding to an oscillatory frequency which is equal to or higher than an audible frequency (20k Hz or higher). The transforming circuit 13 is configured to raise the high-frequency voltages outputted from the output controlling circuit 12, and thus to output the resultant as high-frequency to high voltages. The transforming circuit 13 according to the present embodiment is configured by including transformers L1 and L2. The high-frequency voltages are alternately outputted from these transformers L1 and l2 at regular intervals. The output side of the transforming circuit 13 is connected to the polarity reversing circuit 14 through the two output lines. Thus, the high-frequency voltages outputted from the transformers L1 and L2 are alternately outputted to the polarity reversing circuit 14 through the output lines, respectively.

In the present embodiment, the transforming circuit 13 is configured by including the high-frequency wire-wound transformers or piezoelectric transformers corresponding to the oscillatory frequency which is equal to or higher than the audible frequency (20 kHz or higher). Accordingly, the neutralizer of the present embodiment can be smaller in size and lighter in weight than the AC-type neutralizer.

The polarity reversing circuit 14 is configured to convert the high-frequency high voltages, alternately outputted from the transforming circuit 13 at regular intervals, to two rectangular-wave DC high voltages with different polarities during the same period. Concurrently, the polarity reversing circuit 14 is configured to reverse the polarities of the two DC high voltages at regular intervals, and thus to output the resultant voltages to the first and second group in the discharger 20. Specifically, when the DC high positive-polarity voltage is outputted to the first group, the DC high negative-polarity voltage is simultaneously outputted to the second group. In contrast, when the DC high negative-polarity voltage is outputted to the first group, the DC high positive-polarity voltage is simultaneously outputted to the second group.

The neutralizer according to the present embodiment is configured to apply the two rectangular-wave DC high voltages with polarities different from each other to the first and second groups in the discharger 20. Accordingly, the neutralizer can produce a larger number of positive and negative ions than the AC-type neutralizer, and is thus capable of lowering the potential of the charged neutralization target object to a tolerable level in a shorter than the AC-type neutralizer thereby making the attenuation time characteristic better. Furthermore, the neutralizer can make the neutralization range wider than the AC-type neutralizer, which produces a smaller number of positive and negative ions.

Figure 4:
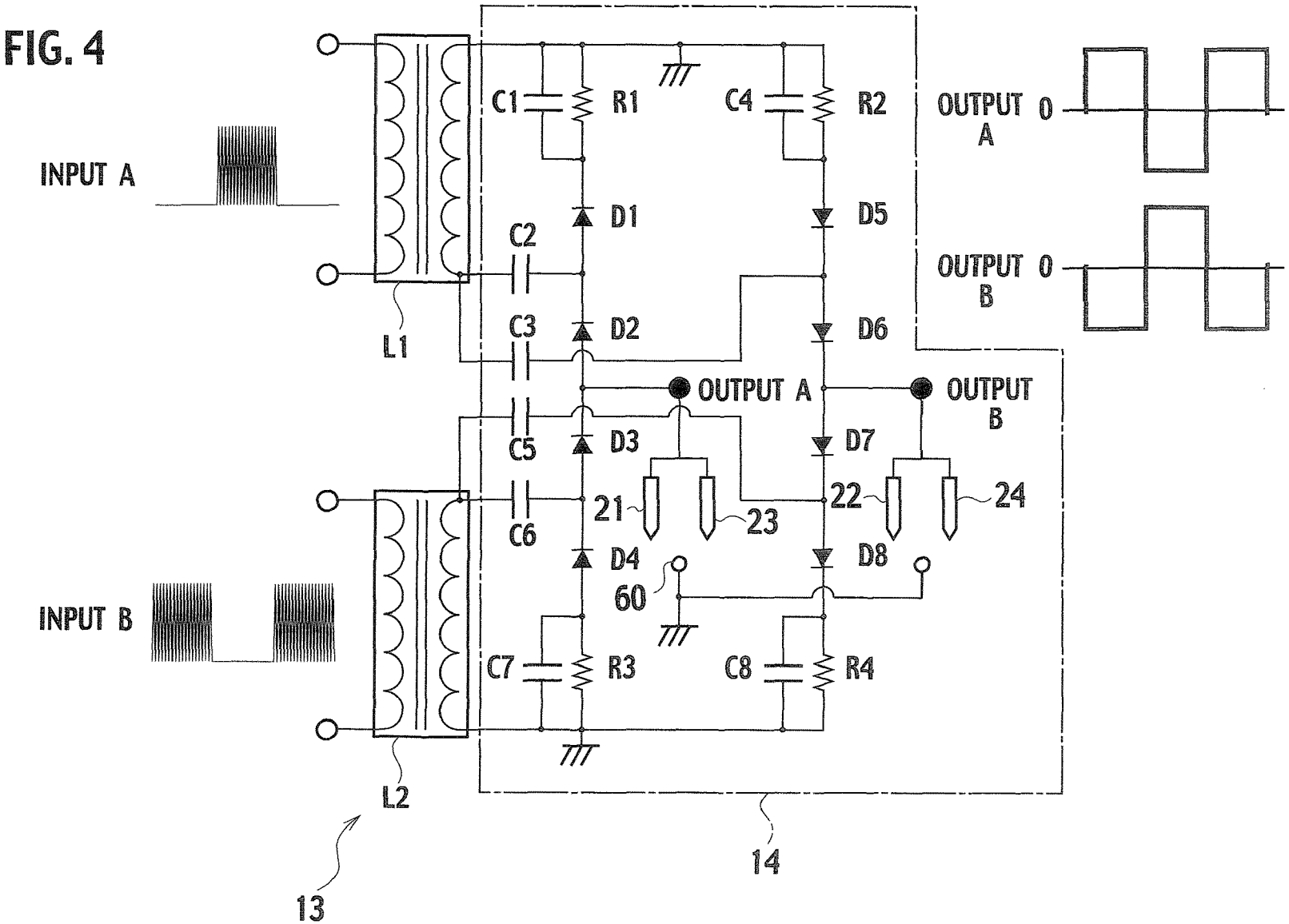
FIG. 4 is a circuit diagram showing a configuration of a polarity reversing circuit.

Next, descriptions will be provided for how the polarity reversing circuit 14 is configured and operated. FIG. 4 is a circuit diagram showing a configuration of the polarity reversing circuit. As shown in FIG. 4, the polarity reversing circuit 14 is made up of a rectifying circuit including capacitors C1 to C8, resistors R1 to R4 and diodes D1 to D8.

The high-frequency high voltages represented by an input A and an input B are alternately supplied from the transformers L1, L2 to the rectifying circuit at regular intervals. The rectifying circuit rectifies the thus-inputted high-frequency high voltages to convert into DC high voltages, hence outputting the resultant voltages from its output terminals indicated by an output A and an output B, respectively.

Once supplied the input A from the transformer L1 (while supplied no input B), the rectifying circuit rectifies the input A. Thereafter, a negative-polarity voltage (corresponding to a rectangular wave of a center portion of the output A) is outputted to the output A, whereas a positive-polarity voltage (corresponding to a rectangular wave of a center portion of the output B) is outputted to the output B. During the next period, once supplied the input B from the transformer L2 (while supplied no input A), the rectifying circuit rectifies the input B. Thereafter, a positive-polarity voltage (corresponding to a rectangular wave of a right portion of the output A) is outputted to the output A, whereas a negative-polarity voltage (corresponding to a rectangular wave of a right portion of the output B) is outputted to the output B. In this manner, the high-frequency high voltages represented by the inputs A and B are alternately supplied to the rectifying circuit from the respective transformers L1, L2 at regular intervals. In response to this, the polarity reversing circuit 14 rectifies and smoothes the thus-received high-frequency high voltages, and concurrently reverses the polarities of the high-frequency high voltages at each cycle, and outputs to the outputs A, B. The discharge needles 21 and 23 of the first group are connected to the output A, whereas the discharge needles 22 and 24 of the second group are connected to the output B. For this reason, the polarities of ions outputted from each of the groups are reversed at regular intervals.

Specifically, during a period A, as shown in FIG. 2(*a*), negative ions are outputted from the discharge needles 21 and 23 of the first group, whereas positive ions are outputted from the discharge needles 22 and 24 of the second group at the same time. During the ensuing period B, as shown in FIG. 2(*b*), positive ions are outputted from the discharge needles 21 and 23 of the first group, whereas negative ions are outputted from the discharge needles 22 and 24 of the second group at the same time. Because the polarity of ions outputted from each group is reversed at regular intervals, ions with different polarities are outputted from the discharge needles of two groups at regular intervals.

Next, descriptions will be provided for the ion balance characteristic of the neutralizer configured in the foregoing manner.

Figure 5:
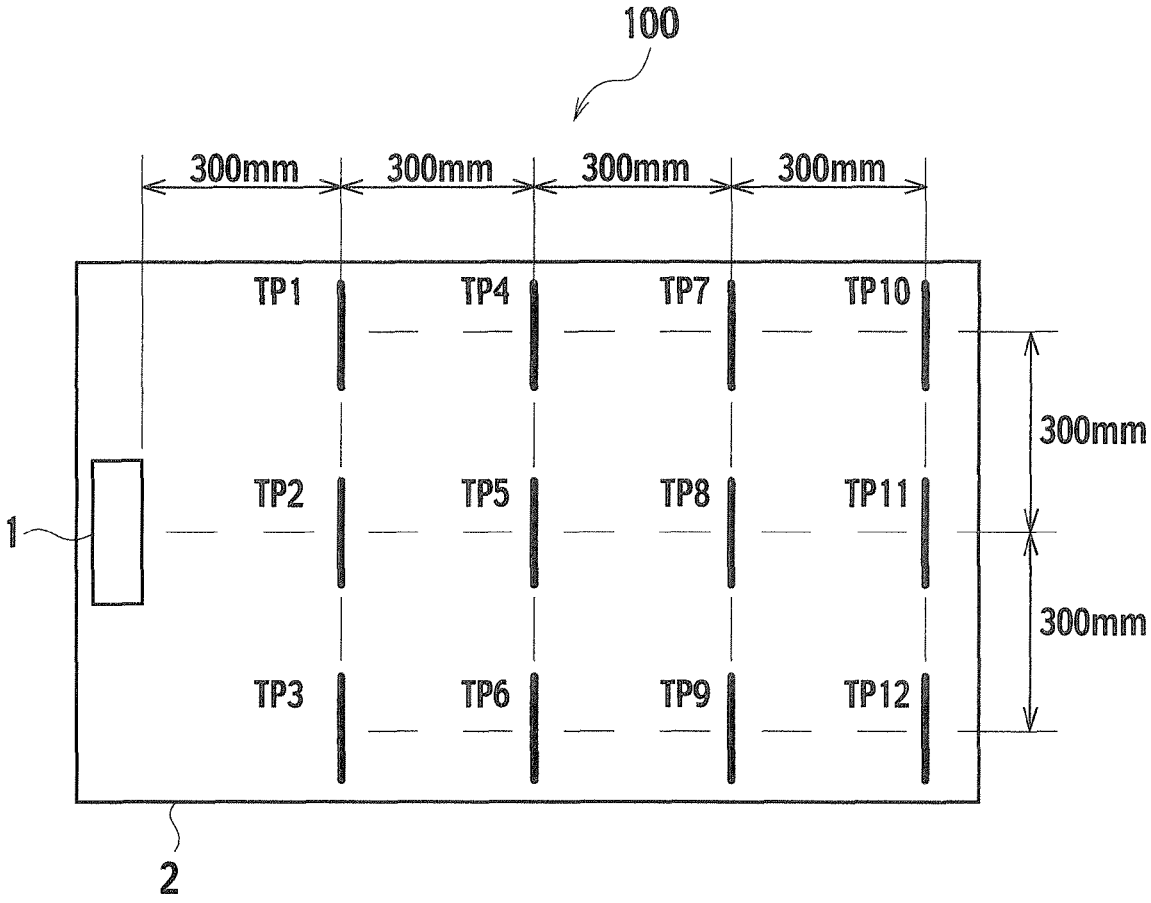
FIG. 5 is an explanatory diagram showing a configuration of an evaluation device.

In general, a measurement method in accordance with the EOS/ESD Standards St3.1 is used to evaluate the neutralizer of this kind. FIG. 5 is an explanatory diagram showing a configuration of an evaluation device used for the measurement method. In this evaluation device 100, charge plates serving as neutralization target objects are sequentially disposed in measurement points TP1 to TP12 on a base board 2, and the neutralizer 1 is placed in a location 300 mm apart from the measurement point TP2. Each charge plate is made of a member with vertical and horizontal dimensions 150 mm×150 mm, and with capacitance 20 pF.

Each charge plate is provided with an unillustrated non-contact type of potential sensor, and a charge electrometer connected to the potential sensor. In addition, an unillustrated +1 kV high voltage supply and an unillustrated −1 kV high voltage supply both configured to electrostatically charge the charge plate while the attenuation time is measured are connected to each charge plate. Furthermore, an unillustrated timer configured to time the attenuation time and an unillustrated digital display unit configured to display the time and the like are also provided.

(1) Ion Balance Variation-Time Characteristic

FIG. 6 is a diagram showing an ion balance variation-time characteristic. FIG. 6(*a*) is a diagram showing the characteristic exhibited by the neutralizer according to the present embodiment. FIG. 6(*b*) is a diagram showing the characteristic exhibited by the pulsed-AC-type neutralizer as a comparative example. In this measurement method, residual potential is eliminated from each charge plate, and thereafter, the neutralizer 1 irradiates ions onto each of the charge plates TP1 to TP12. After a certain period, the potential [V] of each plate is measured. In this example, the distance between the neutralizer 1 and each charge plate is no more than 150 mm. This is for demonstrating the influence of the ion balance variation-time characteristic more conspicuously.

The neutralizer 1 according to the present embodiment is configured to simultaneously produce positive or negative ions from the discharge needles belonging to each of the two thus-divided groups during the same period. Concurrently, the neutralizer 1 is configured to reverse at regular intervals the polarity of ions outputted from each group. Consequently, the polarities of ions emitted from the groups are reversed at regular intervals. In addition, places from which positive and negative ions are emitted are switched at regular intervals. Because this makes the neutralizer 1 simultaneously produce positive and negative ions during the same period, the numbers of positive and negative ions are almost equal to each other on the surface of each charge plate. Accordingly, the neutralizer 1 enhances neutralization of the potential, and is thus capable of reducing the residual potential on the surface of each charge plate. Consequently, as shown in FIG. 6(*a*), the neutralizer 1 can make the variation of ion balance nearly equal to zero, and is concurrently capable of reducing the deviation of the variation. For this reason, the neutralizer 1 according to the present embodiment can evenly eliminate charges from an entire working bench or an entire conveyor, because the neutralizer 1 minimizes the variation and deviation of ion balance even if coming closer to a neutralization target object.

In contrast, the pulsed AC-type neutralizer as the comparative example alternately produces positive and negative ions, and thus charges the charge plate positively and negatively in an alternate manner. In addition, the pulsed AC-type neutralizer produces a larger number of ions than the AC-type neutralizer. For these reasons, as shown in FIG. 6(*b*), the pulsed AC-type neutralizer varies the ion balance. Particularly, when the neutralizer comes close to the charge plate as in this evaluation method, the variation and deviation are large.

Here, descriptions will be provided for a period at which the polarities of ions outputted from the first and second groups are reversed. In the present embodiment, an output switching frequency at which the output controlling circuit alternately switches the high-frequency voltage and outputs to the two output lines is set in a range of 10 Hz to 100 Hz. Like FIG. 6, FIG. 7 shows diagrams each showing an ion balance variation-time characteristic. Each diagram shows a characteristic exhibited by the neutralizer according to the present embodiment. FIG. 7(*a*) is a diagram showing a characteristic when the output switching frequency is set at 1.4 Hz, and FIG. 7(*b*) is a diagram showing a characteristic when the output switching frequency is set at 35 Hz.

When the neutralizer reverses the polarities at a period specified by the output switching frequency of 1.4 Hz, as shown in FIG. 7(*a*), the neutralizer is incapable of reducing the residual potential on the surface of each charge plate, and thus makes the ion balance variation larger. When the output switching frequency is set at 100 Hz or more, the neutralizer has difficulty in causing ions to travel farther, and the attenuation time characteristic gets worse, although not illustrated, like the high-frequency type neutralizer. In contrast, when the neutralizer reverses the polarities at a period specified by the output switching frequency of 35 Hz, as shown in FIG. 7(*b*), the neutralizer can reduce the residual potential on the surface of each charge plate, and is thus capable of making the ion balance variation far smaller.

(2) Ion Balance Space Characteristic

FIG. 8 is a diagram showing an ion balance space characteristic. FIG. 8(*a*) is a diagram showing the characteristic exhibited by the neutralizer according to the present embodiment, and FIG. 8(*b*) is a diagram showing the characteristic exhibited by the DC-type neutralizer as a comparative example. In FIG. 8, the X-axis indicates the potential on each to plate [V]; the Y-axis indicates the distance [mm] to the left and the right seen from the charge plate TP2 located in the center on the front line as a center; and the Z-axis indicates the distance [mm] to the depth direction from the neutralizer (see FIG. 5).

The neutralizer 1 according to the present embodiment is configured to reverse the polarities of emitted positive and negative ions at regular intervals, and also switches the places from which the positive and negative ions are emitted at regular intervals. For these reason, the neutralizer makes the charge plates susceptible to neither positive ions nor negative ions regardless of where the charge plates are located, and is thus capable of almost evenly irradiating positive and negative ions on all the charge plates. Consequently, as FIG. 8(*a*), the neutralizer 1 according to the present embodiment can reduce the spatial deviation of ion balance.

In contrast, the DC-type neutralizer as the comparative example makes some places susceptible to positive ions and other places susceptible to negative ions depending on where the positive and negative electric discharge needles are located. As a result, charge plates located in the places susceptible to either the positive ions or negative ions are charged positively or negatively. For this reason, as shown in FIG. 8(*b*), the DC-type neutralizer causes the ion balance to spatially deviate. FIG. 8(*b*) shows that charge plates (corresponding to TP2, TP3 and the like in FIG. 5) placed near the location of the neutralizer are positively charged.

(3) Ion Balance Temporal Characteristic

The neutralizer 1 according to the present embodiment is configured to reverse at regular intervals the polarities of positive and negative ions emitted from the discharge needles 21 to 24 belonging to the two groups. For this reason, discharge needles almost equally become fouled with dirt, eroded and abraded, even when the neutralizer 1 is continuously operated. Consequently, the residual potentials between the discharge needles do not vary, and the temporal deviation of ion balance can be reduced. When the tip end portion of each discharge needle was observed after the neutralizer 1 according to the present embodiment was continuously operated for a predetermined period, it was confirmed that the tip end portions almost equally become fouled with dirt, eroded and abraded (the illustration of the result of the measurement is omitted).

Besides the foregoing ion balance characteristics, the attenuation time characteristic was measured. The neutralizer 1 according to the present embodiment can produce more positive and negative ions than the AC-type neutralizer or the AC high-frequency type neutralizer does, and is thus caused to have the enhanced attenuation time characteristic. For examining this attenuation time characteristic, a charge plate charged to a high voltage of +1 kV was irradiated with ions by use of the neutralizer 1 according to the present embodiment, and then a measurement was made of a time elapsed until the potential on each charge plate attenuates to +100V. As a result, it was confirmed that the neutralizer 1 needed the attenuation time shorter than the AC-type neutralizer and the AC high-frequency type neutralizer, and made the attenuation time almost as short as the DC-type neutralizer (the illustration of the result of the measurement is omitted).

In addition, the neutralizer 1 is capable producing more positive and negative ions than the AC-type neutralizer, and is thus capable of making the neutralization range wider than the AC-type neutralizer as well. This neutralization range can be also confirmed through the result of the ion balance space characteristic shown in FIG. 8(*a*).

As described above, the transforming circuit of the neutralizer 1 is configured by including the high-frequency wire-wound transformer or piezoelectric transformer corresponding to the oscillatory frequency equal to or higher than the audible frequency (20k Hz or higher). Consequently, the neutralizer 1 can be smaller in size and lighter in weight than the AC-type neutralizer is.

Furthermore, the neutralizer 1 is configured to apply the two rectangular-wave DC high voltages, with polarities different from each other, to the first and second groups in the discharger 20, respectively. For this reason, the neutralizer 1 can produce more positive and negative ions than the AC-type neutralizer, and thus can enhance the attenuation time characteristic better. For the same reason, the neutralizer 1 can make the neutralization range wider than the AC-type neutralizer.

Moreover, the neutralizer 1 according to the present embodiment is configured to simultaneously produce positive and negative ions from the discharge needles of the two thus-divided groups during the same period, and is concurrently configured to reverse at regular intervals the polarity of ions outputted from each group. For these reasons, the polarities of emitted ions are reversed at regular intervals, and concurrently the places from which ions are emitted are changed at regular intervals. Consequently, the neutralizer 1 simultaneously produces positive and negative ions during the same period, and thus makes the number of positive ions and the number of negative ions almost equal to each other on the surface of each charge plate. Accordingly, the neutralizer 1 enhances neutralization of the potential, and is thus capable of reducing the residual potential on the surface of each charge plate. As a consequence of this, the neutralizer 1 can make the ion balance variation close to zero, and is concurrently capable of reducing the deviation of the variation as well.

Additionally, the neutralizer 1 according to the present embodiment is configured to reverse the polarities of emitted ions at regular intervals, and is concurrently configured to switch the places from which ions are emitted at regular intervals. For these reason, the neutralizer 1 makes a neutralization target object susceptible to neither positive ions nor negative ions depending on where the neutralization target object is located, and is thus capable of almost evenly irradiating positive and negative ions on all the charge plates. Consequently, the neutralizer 1 can reduce the spatial deviation of ion balance.

In addition, the neutralizer 1 according to the present embodiment is configured to reverse at regular intervals the polarities of positive and negative ions emitted from the discharge needles of two groups. For this reason, even when the neutralizer 1 is continuously operated, discharge needles almost equally become fouled with dirt, eroded and abraded.

Consequently, the residual potentials of the discharge needles do not vary, and the temporal deviation of ion balance can be reduced.

Furthermore, in the neutralizer 1 according to the present embodiment, the output switching frequency at which the high-frequency voltage is alternately outputted to the two output lines is set in the range of 10 Hz to 100 Hz. For this reason, the neutralizer 1 can make each interval longer between positive and negative ions are produced. Consequently, the neutralizer 1 makes the emitted positive and negative ions less likely to be recombined with each other before the positive and negative ions reach a neutralization target object than the AC high-frequency type neutralizer does, and is thus capable of causing ions to travel farther.

Moreover, as the pulsed streamer-corona detector configured to detect a pulsed signal corresponding to a corona discharge, the electrode 40 for detecting the pulsed streamer-corona and the detecting device 50 of the pulsed streamer-corona signal are provided between the air blower 30 and the discharger 20 in the neutralizer 1 according to the present embodiment. This allows a user to exactly know when the discharge needles should be cleaned, and accordingly to maintain the discharge needles securely.

Additionally, in the neutralizer 1 according to the present embodiment, the guard electrode 60 is provided between the discharger 20 and the neutralization target object 70. With this, the neutralizer 1 can largely reduce the variation of ion balance.

The present invention is not limited to what have been described above, or the descriptions which have been provided for the foregoing embodiment of the invention, but can be implemented in other various aspects by modifying the present invention whenever deemed necessary.

Note that all of the contents of Japanese Patent Application No. 2006-341803 (filed on Dec. 19, 2006) are incorporated herein by reference.

The invention claimed is:

1. A neutralizer comprising:

a power supply circuit configured to generate a DC voltage;

an output controlling circuit configured to convert the DC voltage generated by the power supply circuit to a high-frequency voltage with frequency equal to or higher than an audible frequency, and to output the resultant high-frequency voltage alternately to two output lines at regular intervals;

a transforming circuit configured to raise the high-frequency voltage outputted from the output controlling circuit;

a discharger including 2n (n is an integer equal to one or more) discharge needles configured to output positive ions in response to application of a DC high voltage with a positive polarity, and configured to output negative ions in response to application of a DC high voltage with a negative polarity, the discharge needles being disposed in the discharger while being divided into first and second groups each including n discharge needles;

a polarity reversing circuit configured to convert the high-frequency high voltage outputted from the transforming circuit, to two rectangular-wave DC high voltages with different polarities during a certain period, to output the two DC high voltages respectively to the first and second groups in the discharger while reversing the polarities of the two DC high voltages at regular intervals; and an air blower configured to blow air from a windward side of the discharge needles, and to convey the positive and negative ions outputted from the 2n discharge needles, to a neutralization target object located on a leeward side of the discharge needles, wherein during a certain period, ions with one polarity are outputted from the first group in the discharger, whereas ions with the other polarity are outputted from the second group, and the polarity of the ions outputted from each of the groups is reversed at regular intervals.

2. The neutralizer according to claim 1, wherein the output controlling circuit sets an output switching frequency to be within a range of 10 Hz to 100 Hz, the output switching frequency used to output the high-frequency high voltage alternately to the two output lines at regular intervals.

3. The neutralizer according to claim 1, further comprising:

a pulsed streamer-corona detector provided between the air blower and the discharger, and configured to detect a pulsed signal generated by corona discharge.

4. The neutralizer according to claim 1, further comprising:

a guard electrode provided between the discharger and the neutralization target object, and connected to a ground potential.

* * * * *